US008115420B2

(12) United States Patent
Morooka et al.

(10) Patent No.: US 8,115,420 B2
(45) Date of Patent: Feb. 14, 2012

(54) FILAMENT POWER SUPPLY CIRCUIT FOR VACUUM FLUORESCENT DISPLAY

(75) Inventors: Naoyuki Morooka, Mie (JP); Mizuki Akiyama, Mie (JP); Kazuhisa Shibata, Mie (JP); Toru Kohama, Mie (JP)

(73) Assignees: Noritake Itron Corporation, Mie (JP); Noritake Co., Ltd., Aichi (JP)

( * ) Notice: Subject to any disclaimer, the term of this patent is extended or adjusted under 35 U.S.C. 154(b) by 441 days.

(21) Appl. No.: 12/420,797

(22) Filed: Apr. 8, 2009

(65) Prior Publication Data

US 2009/0256498 A1 Oct. 15, 2009

(30) Foreign Application Priority Data

Apr. 15, 2008 (JP) ..... 2008/105710

(51) Int. Cl.
*H05B 41/36* (2006.01)

(52) U.S. Cl. ..... 315/307; 315/291

(58) Field of Classification Search ..... None
See application file for complete search history.

(56) References Cited

U.S. PATENT DOCUMENTS 5,034,663 A * 7/1991 Cook et al. ..... 315/308
5,319,283 A * 6/1994 Elwell ..... 315/194
5,537,006 A * 7/1996 Wilson et al. ..... 315/127
2007/0285358 A1* 12/2007 Nishioka et al. ..... 345/75.1

FOREIGN PATENT DOCUMENTS

JP 2003-029711 A 1/2003
JP 2005-181413 A 7/2005

* cited by examiner

*Primary Examiner* — Shawki S Ismail
*Assistant Examiner* — Crystal L Hammond
(74) *Attorney, Agent, or Firm* — Blakely, Sokoloff, Taylor & Zafman

(57) ABSTRACT

In a filament power supply circuit of a vacuum fluorescent display, an integration circuit is connected to a signal input terminal which receives a pulse signal having a magnitude corresponding to a DC power supply voltage. A comparison circuit compares an output voltage from the integration circuit with a reference voltage, and outputs a result. A first filament cathode connection terminal is connected to one terminal of the filament cathode of a vacuum fluorescent display and applies the DC power supply voltage to the one terminal. A second filament cathode connection terminal is connected to the other terminal of the filament cathode to ground the other terminal via a capacitive element. A three-terminal element includes first, second, and third terminals. The first terminal is connected to the first filament cathode connection terminal. The second terminal is grounded. The third terminal receives the output from the comparison circuit so that the path between the first terminal and the second terminal is switched in accordance with it.

6 Claims, 6 Drawing Sheets

VFD DRIVING TIMING
(LIGHTING TIMING)

FILAMENT DRIVING VOLTAGE WAVEFORM (1)
T=Tn/m (m IS INTEGER)

FILAMENT DRIVING VOLTAGE WAVEFORM (2)
T≠Tn/m (m IS INTEGER)

FILAMENT POWER SUPPLY CIRCUIT FOR VACUUM FLUORESCENT DISPLAY

BACKGROUND OF THE INVENTION

The present invention relates to a driving circuit for a vacuum fluorescent display and, more particularly, to a driving circuit for supplying power to the filament of a vacuum fluorescent display.

A vacuum fluorescent display is an electron tube which accommodates an anode and a cathode in an evacuated container (envelope) having at least one transparent side surface. The vacuum fluorescent display normally has a triode structure having, between the anode and the cathode, a grid to control movement of electrons emitted by the cathode. In this vacuum fluorescent display, the grid accelerates electrons emitted by the cathode to make them collide against phosphor applied onto the anode. Then, the phosphor emits light, and a desired pattern is displayed.

The cathode normally uses a filament with an electron emission material applied. Power is supplied to the filament to make it generate heat, thereby generating thermoelectrons.

To drive the vacuum fluorescent display, a driving circuit for supplying a filament voltage, a grid voltage, and an anode voltage is necessary.

The filament voltage needs to be a low AC voltage of, e.g., about 5 V. However, the grid voltage and the anode voltage need to be high DC voltages of about 50 V. Normally, the grid and the anode use the same voltage. The grid voltage and the anode voltage will collectively be referred to as a "display voltage" hereinafter.

Conventionally, when supplying the filament voltage and the display voltage to the vacuum fluorescent display, a voltage doubling circuit doubles and rectifies an AC filament voltage to generate a DC display voltage. This arrangement provides partial commonality of the filament voltage power supply and the display voltage power supply.

However, when an AC voltage is doubled and rectified, power loss is large. Additionally, since the voltage doubling circuit becomes hot, the reliability lowers.

A driving circuit which reduces loss by pulse-driving a voltage doubling circuit has been proposed (Japanese Patent Laid-Open Nos. 2003-29711 and 2005-181413).

FIG. 5 shows an example of the arrangement of a driving circuit which pulse-drives a voltage doubling circuit. Referring to FIG. 5, a driving circuit 200 includes a logic power supply 20, a reference oscillator 21, a ½-frequency dividing circuit 22, a filament driver IC 23, and a boost circuit 24.

The logic power supply 20 generates a DC power supply voltage Vcc from an input voltage (DC voltage) Vi.

The reference oscillator 21 includes an inverting amplifier IC, diodes, resistors, and a capacitor, and generates a reference clock signal of about 100 to 200 kHz, as shown in FIG. 6A. The reference clock signal is input to a terminal SEL of the filament driver IC 23. The ½-frequency dividing circuit 22 includes a flip-flop and resistors, and generates an external clock signal by halving the frequency of the reference clock signal, as shown in FIG. 6B. The external clock signal is input to an external clock input terminal EXTCK of the filament driver IC 23.

The filament driver IC 23 switches the input voltage Vi and outputs complimentary differential pulse voltages P1 and P2 from output terminals OUT1 and OUT2 (FIGS. 6C and 6D). The differential pulse voltages P1 and P2 from the filament 6 are supplied to a filament 6 so that an AC filament voltage Ef is applied across the filament 6 (between terminals F1 and F2). When the terminal SEL is at "H" level, an internal clock operation based on an internal oscillator (not shown) of the filament driver IC 23 is performed. When the terminal SEL is at "L" level, an external clock operation based on the external clock signal is performed.

The boost circuit 24 is formed from a voltage doubling circuit including diodes and capacitors, and an emitter follower regulator including a transistor, Zener diodes, resistors, and capacitors. The boost circuit 24 boosts and rectifies the differential pulse voltages P1 and P2 output from the filament driver IC 23, and outputs them as a DC voltage VDD2 for the display voltage.

In the above-described conventional driving circuit, however, when the DC power supply Vi varies, the DC power supply voltage Vcc changes, and the effective voltage supplied to the filament also varies. This causes variations in the amount of electrons emitted by the filament, and degrades the display quality, resulting in, e.g., shorter life of the vacuum fluorescent display or flickering display.

SUMMARY OF THE INVENTION

It is an object of the present invention to suppress degradation in the display quality of a vacuum fluorescent display when a DC power supply voltage Vcc varies.

In order to achieve the above object, according to the present invention, there is provided a filament power supply circuit of a vacuum fluorescent display, comprising an integration circuit connected to a signal input terminal which receives a pulse signal having a magnitude corresponding to a DC power supply voltage, a comparison circuit which is connected to the integration circuit, compares an output voltage from the integration circuit with a reference voltage, and outputs a result, a first filament cathode connection terminal which is connected to one terminal of a filament cathode of a vacuum fluorescent display and applies the DC power supply voltage to the one terminal of the filament cathode, the vacuum fluorescent display including the filament cathode, an anode spaced apart from the filament cathode and having a fluorescent material applied, and an evacuated container that accommodates the filament cathode and the anode, a second filament cathode connection terminal which is connected to the other terminal of the filament cathode to ground the other terminal of the filament cathode via a capacitive element, and a three-terminal element including a first terminal, a second terminal, and a third terminal, the first terminal being connected to the first filament cathode connection terminal, the second terminal being grounded, and the third terminal receiving an output from the comparison circuit so that a path between the first terminal and the second terminal is switched in accordance with the output from the comparison circuit.

DESCRIPTION OF THE PREFERRED EMBODIMENT

The embodiment of the present invention will now be described with reference to the accompanying drawings.

Figure 1:
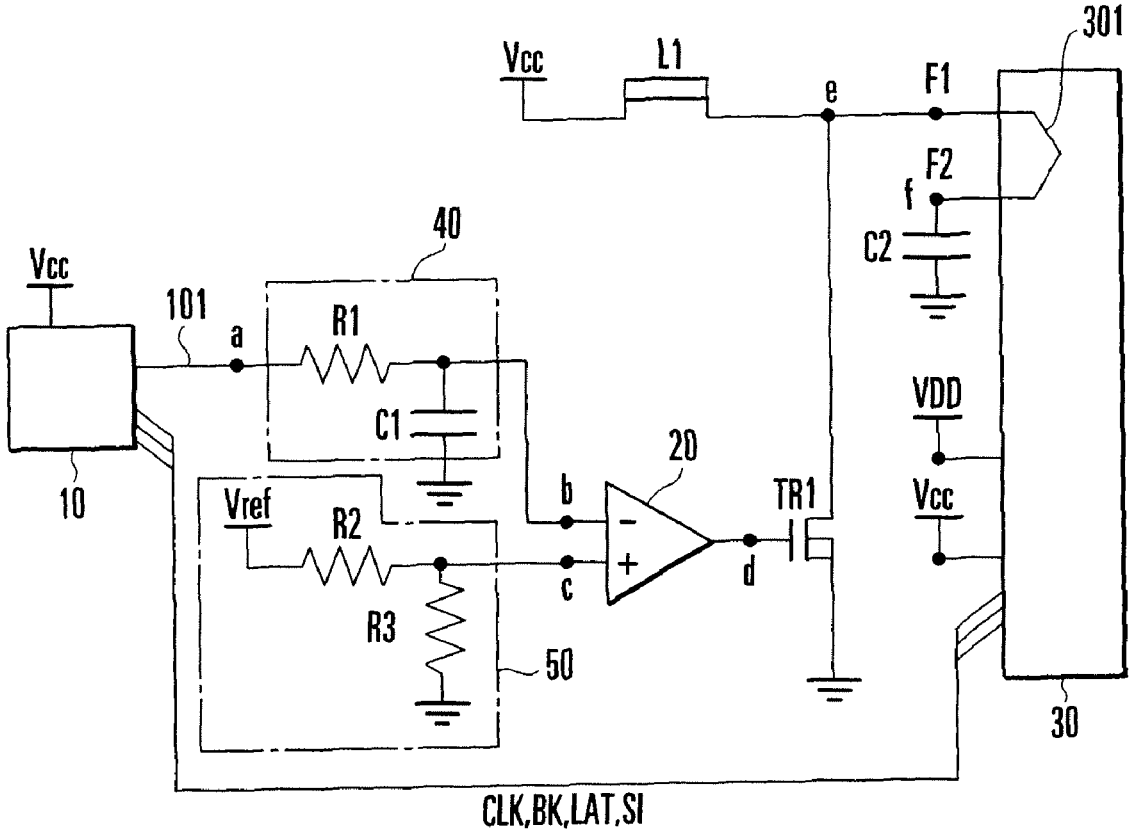
FIG. 1 is a circuit diagram showing the arrangement of a filament power supply circuit for a vacuum fluorescent display according to the embodiment of the present invention.

Referring to FIG. 1, a VFD (Vacuum Fluorescent Display) 30 is formed by accommodating, in an evacuated container made of, e.g., glass, an anode (not shown) formed on a substrate and having a fluorescent material applied, a filament cathode 301 separately arranged above the anode, and a grid electrode (not shown) arranged between the anode and the filament cathode.

The VFD 30 includes filament cathode connection terminals F1 and F2 to which a filament voltage supplied from a filament power supply circuit (to be described later) is applied, power supply terminals to which a DC voltage VDD for a display voltage and a DC power supply voltage Vcc (about 5 V) are applied, and signal input thermals for receiving various kinds of signals CLK, BK, LAT, and SI supplied from an external device (CPU 10 for VFD driving) for driving and display of the VFD 30.

Note that the VFD 30 of this embodiment is of a matrix type including a plurality of anodes arrayed in a matrix viewed from the upper side. However, in the present invention, the VFD may be of a so-called segment type including an anode with an arbitrary shape as far as it uses a filament cathode as an electron source.

The DC voltage VDD for a display voltage may be obtained from the DC power supply voltage Vcc using, e.g., a known voltage doubling circuit. However, FIG. 1 does not illustrate the voltage doubling circuit or the like, and a detailed description thereof will be omitted.

The CPU 10 for VFD driving is a vacuum fluorescent display driving circuit which receives the DC power supply voltage Vcc and outputs the signals CLK, BK, LAT, and SI to drive the VFD 30. The CPU 10 for VFD driving has a clock signal output terminal 101 to output a pulse-like clock signal which has a period corresponding to an integral submultiple of the period of the VFD driving signal and a peak value corresponding to the DC power supply voltage Vcc. The source oscillation of the clock signal output from the clock signal output terminal 101 of the CPU 10 for VFD driving is the same as that of the VFD driving signal (e.g., CLK) output from the CPU 10. Hence, the period of the clock signal can accurately be set to an integral submultiple of the period of the VFD driving signal without synchronization with the VFD driving signal.

In the filament power supply circuit according to this embodiment, the clock signal output from the clock signal output terminal 101 of the CPU 10 for VFD driving is usable as the input signal, i.e., the clock signal for the filament power supply circuit, as will be described later.

[1. Arrangement of Filament Power Supply Circuit]

The filament power supply circuit according to this embodiment includes an RC circuit 40 which receives a pulse signal having a magnitude corresponding to the DC power supply voltage Vcc, a comparison circuit 20 which compares the output voltage of the RC circuit 40 with a reference voltage and outputs the result, and a switching transistor TR1 serving as a three-terminal element which grounds, in accordance with the output from the comparison circuit 20, the filament cathode connection terminal F1 of the VFD 30 to which the DC power supply voltage Vcc is supplied.

More specifically, the RC circuit 40 includes a resistive element R1 having one terminal connected to a signal input terminal a that receives the clock signal output from the CPU 10 for VFD driving, and a capacitive element C1 having one terminal connected to the other terminal of the resistive element R1, and the other terminal grounded. The RC circuit 40 functions as an integration circuit.

The inverting input terminal of the comparison circuit 20 is connected to the node between the resistive element R1 and the capacitive element C1. The voltage across the capacitive element C1 is applied to the inverting input terminal. The noninverting input terminal of the comparison circuit 20 is connected to the output terminal of a reference voltage circuit 50. A predetermined reference voltage is applied to the noninverting input terminal.

Note that the reference voltage circuit 50 outputs a predetermined reference voltage Vs (=Vref×R3/(R2+R3)) by dividing a predetermined voltage Vref by resistive elements R2 and R3.

The first filament cathode connection terminal F1 is connected to one terminal of the filament cathode 301 of the VFD 30 to apply the DC power supply voltage Vcc to the one terminal of the filament cathode 301 via an inductance L1. On the other hand, the second filament cathode connection terminal F2 is connected to the other terminal of the filament cathode 301 to ground the other terminal of the filament cathode 301 via a capacitive element C2. Hence, when the first and second filament cathode connection terminals F1 and F2 are connected to the filament cathode 301, an LC circuit including the inductance L1 and the capacitive element C2 is formed.

In the switching transistor TR1, the drain terminal serving as the first terminal is connected to the first filament cathode connection terminal F1. The source terminal serving as the second terminal is grounded. The output from the comparison circuit 20 is input to the gate terminal serving as the third terminal so that the path between the drain and source is switched in accordance with the output from the comparison circuit 20.

[2. Operation of Filament Power Supply Circuit]

The operation of the filament power supply circuit according to this embodiment will be described next with reference to FIGS. 2A to 2E and 3A to 3E. FIGS. 2A to 2E and 3A to 3E show time-rate changes in voltages at the following points of the filament power supply circuit.

Figure 2A:
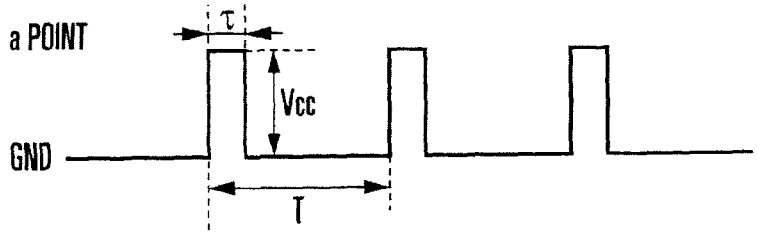
FIGS. 2A to 2E are timing charts for explaining the operation of the filament power supply circuit shown in FIG. 1.
Figure 2B:
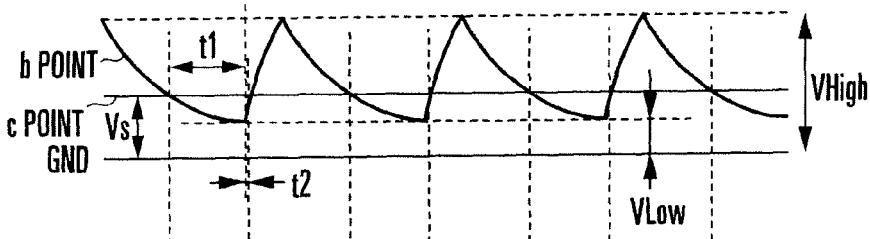
Figure 3A:
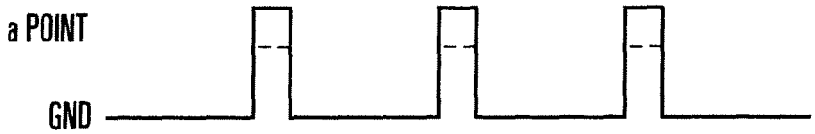
FIGS. 3A to 3E are timing charts for explaining the operation of the filament power supply circuit shown in FIG. 1.
Figure 3B:
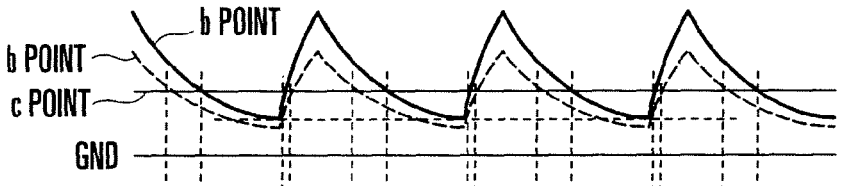

FIGS. 2A and 3A: the signal input terminal (point a in FIG. 1) of the filament power supply circuit FIGS. 2B and 3B: the inverting input terminal (point b) and the noninverting input terminal (point c) of the comparison circuit 20

Figure 2C:
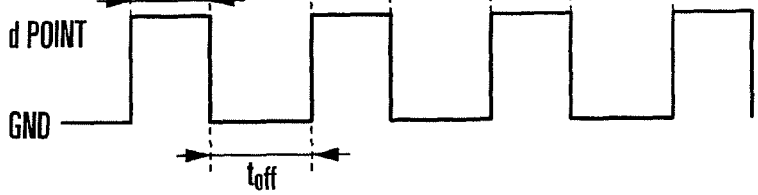
Figure 3C:
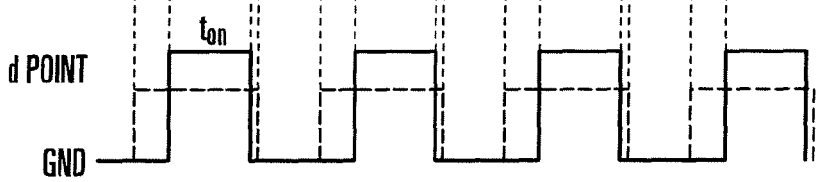

FIGS. 2C and 3C: the output signal (point d) of the comparison circuit 20

Figure 2D:
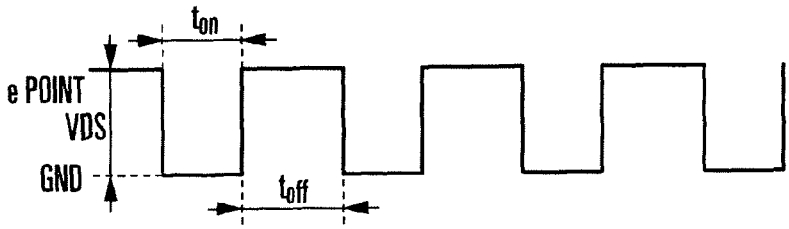
Figure 3D:
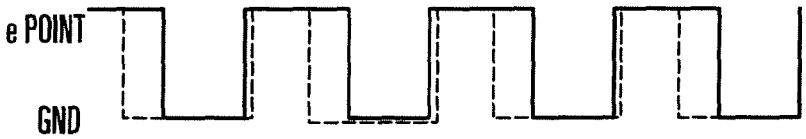

FIGS. 2D and 3D: the first filament cathode connection terminal F1 (point e)

Figure 2E:
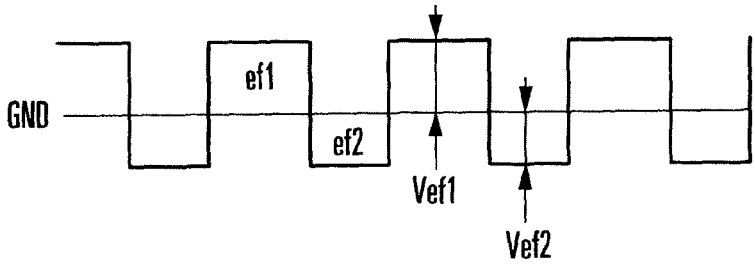
Figure 3E:
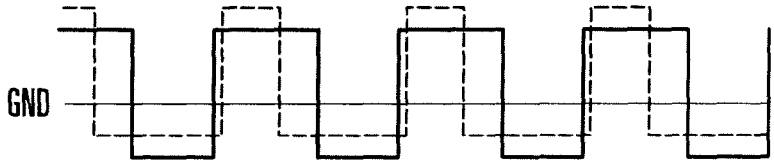

FIGS. 2E and 3E show time-rate changes in a voltage supplied to the filament cathode.

[2.1. Basic Operation of Filament Power Supply Circuit]

The basic operation of the filament power supply circuit according to this embodiment will be described first with reference to FIGS. 2A to 2E.

As shown in FIG. 2A, the clock signal output from the CPU 10 for VFD driving and input to the signal input terminal (point a) is a pulse-like signal having the peak value Vcc, a period T, and an ON time τ.

The clock signal is input to the RC circuit including the resistive element R1 and the capacitive element C1. The voltage across the capacitive element C1 exhibits a sawtooth-shaped change, as shown in FIG. 2B, in accordance with a time constant determined by the resistive element R1 and the capacitive element C1. This voltage is input to the inverting input terminal (point b) of the comparison circuit 20.

On the other hand, the predetermined voltage Vs is input to the noninverting input terminal (point c) of the comparison circuit 20. As a result, a signal that is ON (ton=t1+t2) while the noninverting input of the comparison circuit 20 is larger than the inverting input and OFF (toff=T−ton) while the noninverting input is smaller than the inverting input is output to the output terminal (point d) of the comparison circuit 20, as shown in FIG. 2C.

VHIGH, VLOW, t1, and t2 of the voltage waveform of the inverting input terminal (point b) are given by $$VHIGH=Vcc\times\{1-e^{-(\tau/R1C1)}\}/\{1-e^{-(T/R1C1)}\} \quad (1)$$

$$VLOW=VHIGH\times e^{-((T-\tau)/R1C1)} \quad (2)$$

$$t1=-R1\times C1\times\ln(VLOW/Vs) \quad (3)$$

$$t2=-R1\times C1\times\ln\{(Vcc-Vs)/(Vcc-VLOW)\} \quad (4)$$

When the signal shown in FIG. 2C is input to the gate terminal of the switching transistor TR1 to turn on/off the path between the drain and source, the change in the potential of the first filament cathode connection terminal F1 (point e) has a phase opposite to that of the output signal (FIG. 2C) of the comparison circuit 20, as shown in FIG. 2D.

At this time, a potential VDS of the first filament cathode connection terminal F1 can be represented by a function of a duty D of the output from the comparison circuit 20, and is given by $$\begin{aligned} VDS &= Vcc\times(T/toff) \\ &= Vcc/(1-D) \end{aligned} \quad (5)$$

where D=ton/T

Consequently, every time the path between the drain and source of the switching transistor TR1 is turned on/off, the capacitive element C2 is repeatedly charged and discharged, and a voltage (filament voltage) shown in FIG. 2E is applied to the filament cathode 301. At this time, a forward voltage Vef1 and a reverse voltage Vef2 applied to the filament cathode 301 are given by $$\begin{aligned} Vef1 &= VDS - VF2 \\ &= D\times Vcc/(1-D) \end{aligned} \quad (6)$$

$$Vef2 = VF2 = Vcc \quad (7)$$

Since charges removed from the capacitive element C2 via the filament 301 upon turning on the switching transistor TR1 equal those stored in the capacitive element C2 via the filament 301 upon turning off the switching transistor TR1, the potential of the second filament cathode connection terminal F2 is given by VF2=Vcc. To satisfy VF2=Vcc described above, the second filament cathode connection terminal F2 may directly be connected to the DC power supply voltage Vcc.

The effective values of the voltages applied to the filament cathode are given by $$\begin{aligned} ef1 &= Vef1\times(1-D)^{1/2} \\ &= Vcc\times D\times(1-D)^{1/2} \end{aligned} \quad (8)$$

$$ef2 = Vef2\times D^{1/2} \quad (9)$$

The filament voltage is given by $$Ef=(ef1^2+ef2^2)^{1/2} \quad (10)$$

As is apparent from the above description, the filament voltage Ef is represented by a function of the clock signal period T, ON time τ, resistance R1, capacitance C1, predetermined reference voltage Vs, and DC power supply voltage Vcc.

The parameter values are set to minimize the variation in the filament voltage Ef caused by the variation in the DC power supply voltage Vcc. This makes it possible to stabilize the filament voltage Ef and suppress degradation in the display quality of the VFD when the DC power supply voltage Vcc varies.

[2.2. Variation in DC Power Supply Voltage Vcc and Operation of Filament Power Supply Circuit]

The operation of the filament power supply circuit when the DC power supply voltage Vcc varies will be described next with reference to FIGS. 3A to 3E.

When the DC power supply voltage Vcc lowers, as indicated by the broken lines in FIG. 3A, the voltage across the capacitive element C1, i.e., the input voltage signal of the inverting input terminal (point b) of the comparison circuit 20 also lowers, as indicated by the broken line in FIG. 3B. To the contrary, the potential Vs of the noninverting input terminal (point c) of the comparison circuit 20 is always constant regardless of the value of the DC power supply voltage Vcc.

Hence, when the DC power supply voltage Vcc lowers, the time during which the inverting input of the comparison circuit 20 is smaller than the noninverting input becomes longer. Hence, as shown in FIG. 3C, the duty of the output from the comparison circuit 20 changes. The ON time ton is longer, and the OFF time toff is shorter.

When the DC power supply voltage Vcc lowers, the ON time ton of the output of the comparison circuit 20 becomes longer, and the OFF time toff becomes shorter. That is, the duty D of the output of the comparison circuit 20 increases.

If the duty D increases, the time during which the path between the drain and source of the switching transistor TR1 is turned off to apply the voltage Vef1 to the first filament cathode connection terminal F1 via the boost coil L1 shortens, as indicated by the broken line in FIG. 3E. At the same time, the value of the voltage Vef1 increases, as is apparent from equation (6).

On the other hand, when the DC power supply voltage Vcc rises, the duty D of the output of the comparison circuit 20 decreases. For this reason, the time during which the path between the drain and source of the switching transistor TR1 is turned off to apply the voltage Vef1 to the first filament cathode connection terminal F1 via the boost coil L1 becomes long, and the value of the voltage Vef1 decreases.

Even when the DC power supply voltage Vcc varies, the filament voltage applied to the filament cathode 301 and its application time vary to absorb the variation in the DC power supply voltage Vcc. It is therefore possible to stabilize the filament voltage even when the DC power supply voltage Vcc varies, and suppress degradation in the display quality of the VFD caused by the variation in the DC power supply voltage Vcc.

As described above, the clock signal for the filament power supply circuit, which is supplied from the clock signal output terminal 101 of the CPU 10 for VFD driving, is based on the same source oscillation as that of the various signals CLK, BK, LAT, and SI to drive the VFD 30. Hence, the period of the clock signal can accurately be set to an integral submultiple of the period of the VFD driving signal.

Figures 4A, 4B, 4C:
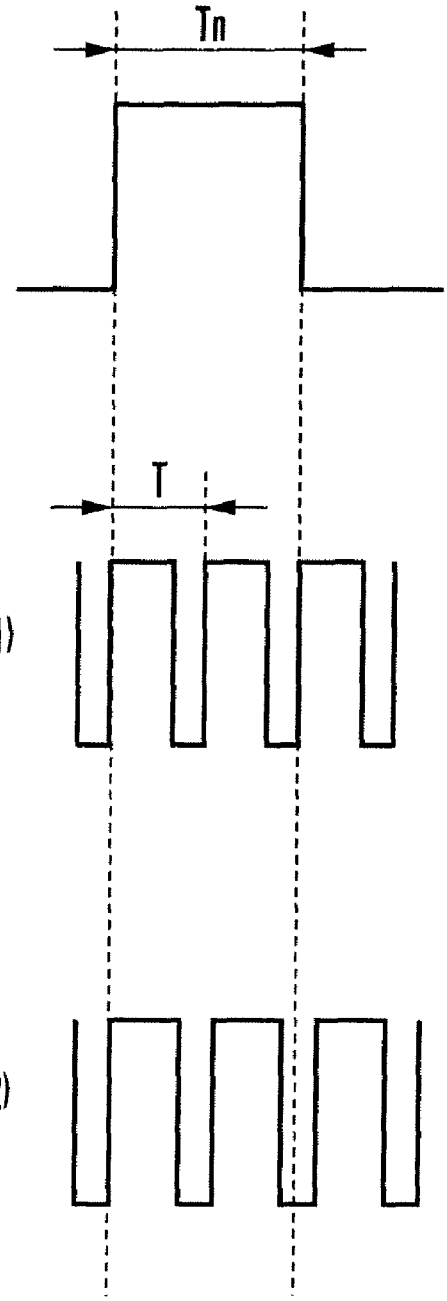
FIGS. 4A to 4C are timing charts for explaining the relationship between the vacuum fluorescent display lighting timing and the filament driving voltage waveform.
Figure 5:
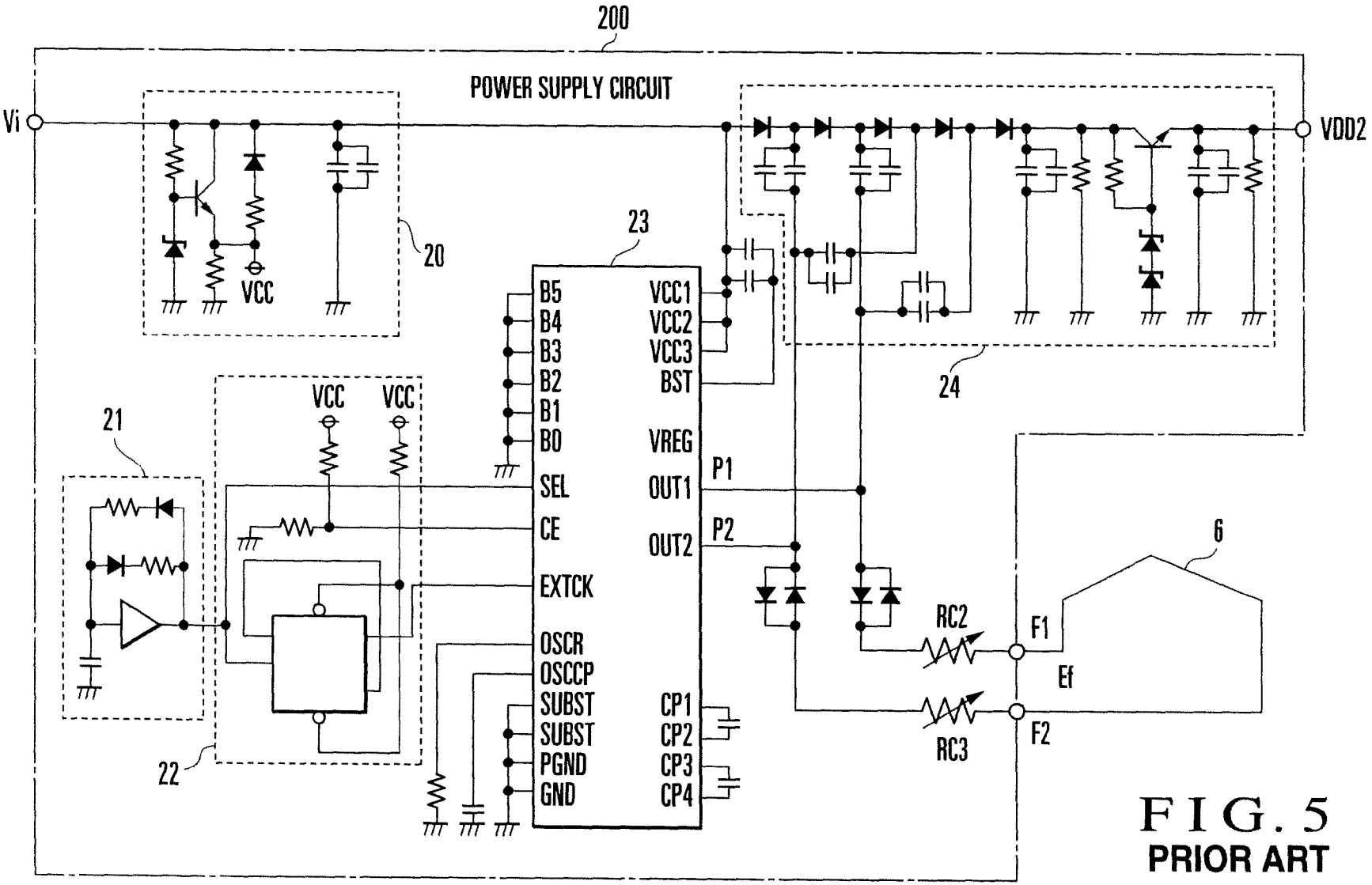
FIG. 5 PRIOR ART
FIG. 5 is a circuit diagram showing an example of the arrangement of a conventional driving circuit.
Figure 6A:
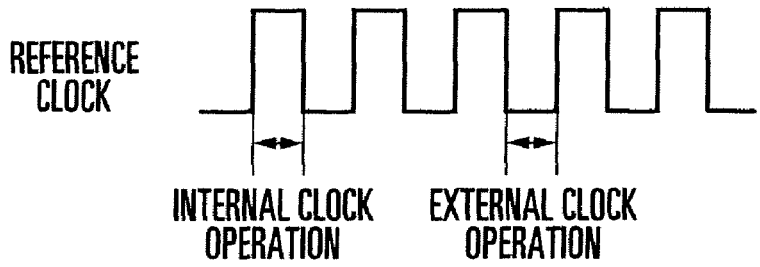
FIG.6A PRIOR ART
FIGS. 6A to 6D are timing charts for explaining the operation of the driving circuit shown in FIG. 5.
Figure 6B:
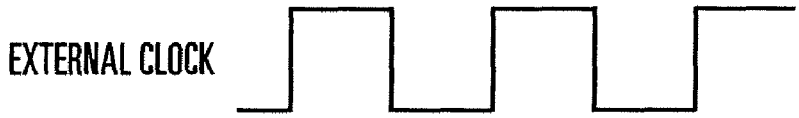
FIG.6B PRIOR ART
Figure 6C:
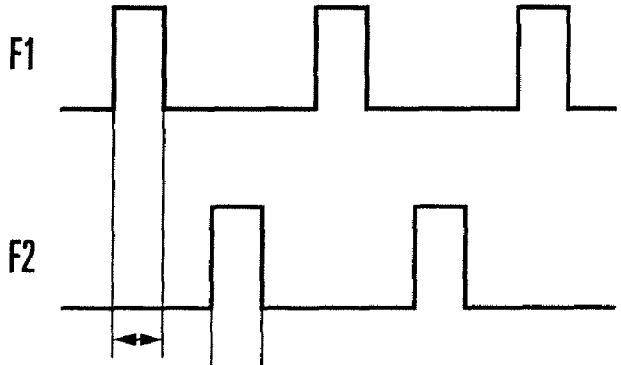
FIG.6C PRIOR ART
Figure 6D:
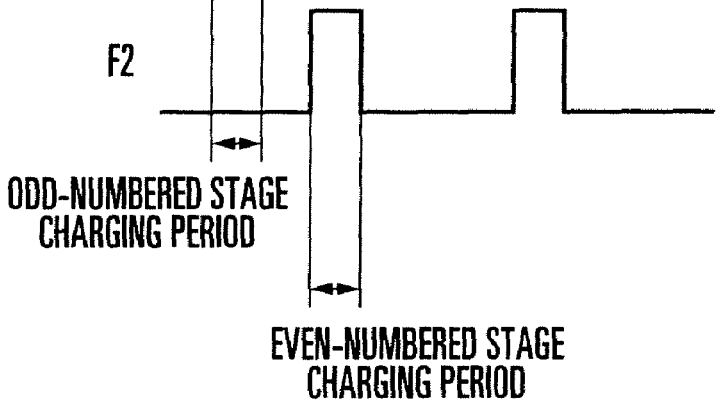
FIG.6D PRIOR ART

FIGS. 4A to 4C show the relationship between the VFD lighting timing and the filament driving voltage waveform. In this embodiment, the period T of the filament driving voltage is an integral submultiple of the period of the VFD driving signal. For this reason, a given lighting time Tn always includes an integral number of (m) periods T of the filament driving voltage (T=Tn/m), as shown in FIG. 4B. Hence, the effective value of the filament voltage is also constant. To the contrary, if the lighting time Tn is not an integral multiple of the period T of the filament driving voltage (T≠Tn/m), as shown in FIG. 4C, the effective value varies in every lighting time Tn.

As described above, the clock signal for the filament power supply circuit, which is output from the CPU 10 for VFD driving and has a period corresponding to an integral submultiple of the period of the driving signal, is used as the input signal. For this reason, the number of clocks of the filament power supply circuit during the lighting timing is always an integer, and a predetermined effective voltage is supplied to the filament during each lighting timing. This improves the display quality.

When the output from the CPU 10 for VFD driving is used, no separate oscillation circuit for the filament power supply circuit is necessary.

In this embodiment, the clock signal output from the CPU 10 for VFD driving is used as the input signal. In the present invention, however, it is not always necessary to input the clock signal supplied from the CPU 10 for VFD driving. Any other oscillation circuit may supply a clock signal if it can supply a clock signal having a stable frequency and duty.

In this embodiment, the RC circuit 40 is used as an integration circuit. However, an integration circuit having another arrangement may be used.

It is only necessary that the comparison circuit 20 is designed to output a signal representing the relationship in the magnitude between the reference voltage and the output voltage from the RC circuit 40, and the switching transistor TR1 is designed to turn on the path between the drain and source when the output voltage from the RC circuit 40 is lower than the reference voltage, and turn off the path between the drain and source when the output voltage from the RC circuit 40 is higher than the reference voltage.

As described above, according to this embodiment, it is therefore possible to stabilize the filament voltage even when the DC power supply voltage Vcc varies, and suppress degradation in the display quality of the VFD 30 caused by the variation in the DC power supply voltage Vcc.

The clock signal for the filament power supply circuit, which is output from the CPU 10 for vacuum fluorescent display driving and has a period corresponding to an integral submultiple of the period of the driving signal, is used as the input signal. This makes it possible to accurately set the period of the filament power supply circuit to an integral submultiple of the lighting timing of the vacuum fluorescent display 30 and improve the display quality.

What is claimed is:

1. A filament power supply circuit of a vacuum fluorescent display, comprising:

an integration circuit connected to a signal input terminal which receives a pulse signal having a magnitude corresponding to a DC power supply voltage;

a comparison circuit which is connected to said integration circuit, compares an output voltage from said integration circuit with a reference voltage, and outputs a result;

a first filament cathode connection terminal which is connected to one terminal of a filament cathode of a vacuum fluorescent display and applies the DC power supply voltage to said one terminal of the filament cathode, the vacuum fluorescent display including the filament cathode, an anode spaced apart from the filament cathode and having a fluorescent material applied, and an evacuated container that accommodates the filament cathode and the anode;

a second filament cathode connection terminal which is connected to the other terminal of the filament cathode to ground said other terminal of the filament cathode via a capacitive element; and a three-terminal element including a first terminal, a second terminal, and a third terminal, the first terminal being connected to said first filament cathode connection terminal, the second terminal being grounded, and the third terminal receiving an output from said comparison circuit so that a path between the first terminal and the second terminal is switched in accordance with the output from said comparison circuit.

2. A circuit according to claim 1, further comprising an inductance connected to said first filament cathode connection terminal, wherein said first filament cathode connection terminal applies the DC power supply voltage to said one terminal of the filament cathode via said inductance.

3. A circuit according to claim 1, wherein said integration circuit comprises:

a resistive element having one terminal connected to the signal input terminal; and a capacitive element having one terminal connected to the other terminal of said resistive element and the other terminal grounded, and said comparison circuit is connected to a node between said resistive element and said capacitive element.

4. A circuit according to claim 1, wherein said comparison circuit comprises an inverting input terminal and a noninverting input terminal, said inverting input terminal being connected to said integration circuit, and said noninverting input terminal receiving the reference voltage.

5. A circuit according to claim 1, wherein said comparison circuit outputs a signal representing a relationship in magnitude between the reference voltage and the output voltage from said integration circuit, and said three-terminal element turns on the path between the first terminal and the second terminal when the output voltage from said integration circuit is lower than the reference voltage, and turns off the path between the first terminal and the second terminal when the output voltage from said integration circuit is higher than the reference voltage.

6. A circuit according to claim 1, further comprising a vacuum fluorescent display driving circuit which supplies a driving signal to the anode of the vacuum fluorescent display upon receiving the DC power supply voltage, and outputs a clock signal for the filament power supply circuit to the signal input terminal, the clock signal having a period corresponding to an integral submultiple of a period of the driving signal.

* * * * *